US010611513B2

(12) United States Patent
Novotny et al.

(10) Patent No.: US 10,611,513 B2
(45) Date of Patent: Apr. 7, 2020

(54) PAPERBOARD CARTON

(71) Applicant: General Mills, Inc., Minneapolis, MN (US)

(72) Inventors: Peter L Novotny, Crystal, MN (US); George A Tuszkiewicz, Plymouth, MN (US)

(73) Assignee: General Mills, Inc., Minneapolis, MN (US)

( * ) Notice: Subject to any disclaimer, the term of this patent is extended or adjusted under 35 U.S.C. 154(b) by 189 days.

(21) Appl. No.: 15/115,131

(22) PCT Filed: Jan. 29, 2014

(86) PCT No.: PCT/US2014/013520
§ 371 (c)(1),
(2) Date: Jul. 28, 2016

(87) PCT Pub. No.: WO2015/116049
PCT Pub. Date: Aug. 6, 2015

(65) Prior Publication Data
US 2016/0347497 A1 Dec. 1, 2016

(51) Int. Cl.
*B65D 5/32* (2006.01)
*B65D 5/00* (2006.01)

(52) U.S. Cl.
CPC ..... *B65D 5/323* (2013.01); *B65D 5/0015* (2013.01); *B65D 5/324* (2013.01)

(58) Field of Classification Search
CPC ..... B65D 5/323; B65D 5/0015; B65D 5/324; B65D 2301/10
USPC ..... 229/120, 122.24, 919, 122.21, 122.32; 493/84, 906
See application file for complete search history.

(56) References Cited

U.S. PATENT DOCUMENTS

| | | | |
|---|---|---|---|
| 269,170 | A | 12/1882 | Bragdon |
| 380,364 | A | 4/1888 | Surles |
| 674,009 | A | 5/1901 | Lewis |
| 1,265,273 | A | 5/1918 | Stokes et al. |
| 1,512,157 | A | 10/1924 | Bliss |
| 1,514,367 | A | 11/1924 | Bliss |
| 1,895,778 | A | 1/1933 | Andrews |

(Continued)

FOREIGN PATENT DOCUMENTS

WO WO 1994/012328 6/1994

OTHER PUBLICATIONS

Urbanik, "*Machine Direction Strength Theory of Corrugated Fiberboard*", Journal of Composites Technology & Research, JCTRER, vol. 18, No. 2, Apr. 1996, pp. 80-88.

(Continued)

*Primary Examiner* — Christopher R Demeree
(74) *Attorney, Agent, or Firm* — Diederiks & Whitelaw, PLC; Gregory P. Kaihoi, Esq.

(57) ABSTRACT

A paperboard carton is formed by interconnecting a main body piece, folded to establish at least a bottom wall and first and second spaced side panels, with separately formed third and fourth side panels. To strengthen the carton and enable similarly configured cartons to be effectively, vertically stacked, a caliper or basis weight of each of the third and fourth side panels is made greater than the main body piece and/or an orientation of the fibers between the pieces is varied as compared to a conventional carton.

18 Claims, 5 Drawing Sheets

(56) References Cited

U.S. PATENT DOCUMENTS

| | | | | | |
|---|---|---|---|---|---|
| 2,149,955 | A | | 3/1939 | Burns | |
| 2,374,390 | A | | 4/1945 | Snyder | |
| 2,593,778 | A | * | 4/1952 | McGinnis | B65D 5/742 229/248 |
| 2,606,709 | A | | 8/1952 | Carey et al. | |
| 2,609,138 | A | | 9/1952 | Weiss | |
| 2,701,679 | A | * | 2/1955 | Goldstein | B65D 5/744 229/215 |
| 2,947,414 | A | | 8/1960 | Johnson | |
| 3,007,622 | A | | 11/1961 | George | |
| 3,099,379 | A | * | 7/1963 | Stease | B65D 5/323 229/117.16 |
| 3,217,924 | A | | 11/1965 | Chidsey, Jr. | |
| 3,237,838 | A | | 3/1966 | Elias | |
| 3,291,370 | A | * | 12/1966 | Elias | B65D 5/0227 229/104 |
| 3,788,538 | A | | 1/1974 | Kuenzi | |
| 3,993,239 | A | | 11/1976 | Exel | |
| 4,040,559 | A | | 8/1977 | Giebel | |
| 4,211,358 | A | | 7/1980 | Crane | |
| 4,620,479 | A | | 11/1986 | Diamond et al. | |
| 4,655,386 | A | | 4/1987 | Billberg | |
| 4,871,063 | A | | 10/1989 | Kumbier | |
| 4,884,739 | A | | 12/1989 | Nederveld | |
| 5,201,461 | A | | 4/1993 | Sykora | |
| 5,316,207 | A | | 5/1994 | Ross et al. | |
| 5,333,779 | A | * | 8/1994 | Sykora | B65D 5/326 229/122.21 |
| 5,390,847 | A | | 2/1995 | Young | |
| 5,419,485 | A | | 5/1995 | Petriekis et al. | |
| 5,497,939 | A | | 3/1996 | Heiskell et al. | |
| 5,562,246 | A | | 10/1996 | Smith et al. | |
| 5,639,015 | A | | 6/1997 | Petriekis et al. | |
| 5,839,650 | A | | 11/1998 | Sheffer | |
| 6,050,484 | A | | 4/2000 | Galomb | |
| 6,062,467 | A | | 5/2000 | Ours et al. | |
| 6,138,904 | A | | 10/2000 | Baird et al. | |
| 6,168,074 | B1 | | 1/2001 | Petriekis et al. | |
| 6,186,393 | B1 | * | 2/2001 | Tsamourgelis | B65D 5/32 229/122.26 |
| 6,712,214 | B1 | | 3/2004 | Wintermute et al. | |
| 7,070,054 | B2 | | 7/2006 | Scrymgeour et al. | |
| 7,074,171 | B2 | | 7/2006 | Mahlum et al. | |
| 8,196,806 | B2 | | 6/2012 | Tao | |
| 8,695,870 | B2 | | 4/2014 | Etzel et al. | |
| 8,763,890 | B2 | | 7/2014 | Clark et al. | |
| 8,777,097 | B2 | | 7/2014 | Jacomelli et al. | |
| 8,875,983 | B2 | | 11/2014 | Lenhard et al. | |
| 2003/0038169 | A1 | | 2/2003 | Thibault | |
| 2006/0113364 | A1 | | 6/2006 | Bonner et al. | |
| 2007/0152029 | A1 | | 7/2007 | Gardner | |
| 2013/0020383 | A1 | | 1/2013 | Tautz et al. | |
| 2014/0013716 | A1 | | 1/2014 | Mallard | |

OTHER PUBLICATIONS

Grain Direction, The Paper Mill Store, Oct. 11, 2013.

* cited by examiner

PAPERBOARD CARTON

CROSS-REFERENCE TO RELATED APPLICATIONS

The present application represents a National Stage application of PCT/US2014/013520 entitled "Paperboard Carton" filed Jan. 29, 2014, pending.

FIELD OF THE INVENTION

The invention generally pertains to packaging products, particular food products, in cartons and, more specifically, to a paperboard carton made from multiple, separate pieces having structural characteristics which vary in fiber orientation, basis weight and/or overall material.

BACKGROUND OF THE INVENTION

In connection with shipping various types of products, such as food products, from a manufacturer to a retail establishment, it is known to initially package the products in cartons. Although various materials could be used in making the cartons, the most common material employed is paperboard. In general, the paperboard is provided in the form of a blank which can be conveniently stored in a flat configuration or side seamed configuration but easily erected through a simple folding operation to establish an open-ended carton which can be filled and sealed, typically in an automated process. Multiple cartons are then typically arranged side-by-side in a corrugated box for shipping through designated distribution channels to the retail establishment, such as a grocery store, where the cartons in each shipping box can be unloaded and arranged on a display shelf for sale to consumers.

Known end load cartons of this type are not only lightweight, but the paperboard is advantageously recyclable. However, such paperboard cartons lack significant compression strength, leading to the need for the cartons to be loaded side-by-side in the protective, outer corrugated shipping boxes. If additional strength is needed for shipping purposes, common sense would dictate strengthening a single corrugated box which can hold numerous paperboard cartons rather than incurring the added expense of reinforcing each paperboard carton. With this in mind, certain advancements have been made in the area of corrugated boxes to enable numerous loaded boxes to be stacked on one another, while avoiding crushing of the boxes and stacking forces from being borne by the cartons. For example, enhanced lamination configurations, fluting techniques and material variations represent certain approaches commonly considered in the industry.

It would certainly be beneficial and cost effective to also minimize the amount of corrugated fiber needed in the industry. This could be addressed by enabling paperboard cartons to be stacked and to directly bear some or all of the associated vertical forces. To this end, it is considered advantageous to enable various products, particularly food products, to be packaged in paperboard cartons which themselves are strengthened to enable vertical stacking. Even further, it would be unprecedented if the paperboard cartons could even be shipped in a stacked configuration without the need for an outer container, such as a corrugated box. Certainly, this goal is achievable, but has not been considered practical, particularly as the added cost of bolstering the strength of the cartons, taking into account the sheer volume of such paperboard cartons used in the food industry alone, would be prohibitive. Still, in light of the known drawbacks, it would be desirable to provide paperboard cartons which are stronger so as to enhance their ability to be stacked if the same could be economically accomplished.

SUMMARY OF THE INVENTION

The invention is directed to forming a paperboard carton from multiple, separate pieces, with the pieces varying in at least one of fiber orientation, basis weight and material construction. In accordance with the invention, carton strength is increased, while the amount of fiber utilized, as compared to a conventional carton, is held constant or reduced.

More specifically, a carton constructed in accordance with the invention is formed from a main body piece which is folded to establish at least a bottom wall, and first and second spaced side or face panels each including first and second opposing side edge portions, a third side panel extending between the bottom wall and the first side edge portions of the first and second side panels, and a fourth side panel extending between the bottom wall and the second side edge portions of the first and second side panels. Overall, the main body piece, the third side panel and the fourth side panel constitute separate pieces which are interconnected to form the carton with an interior cavity containing a product to be sold to a consumer; each of the main body piece, the third side panel and the fourth side panel is formed of paperboard; a caliper of each of the third side and fourth side panels is greater than the main body piece, although smaller in area; the fiber orientation of each of the third and fourth side panels directionally differs from each of the first and second side panels; and the carton exhibits a compression strength which enables similarly configured ones of the cartons to be directly stacked for shipping purposes.

Additional objects, features and advantages of the invention will become more readily apparent from the following detailed description when taken in conjunction with the drawings wherein like reference numerals refer to corresponding parts in the several views.

DETAILED DESCRIPTION OF EMBODIMENTS

Figure 1:
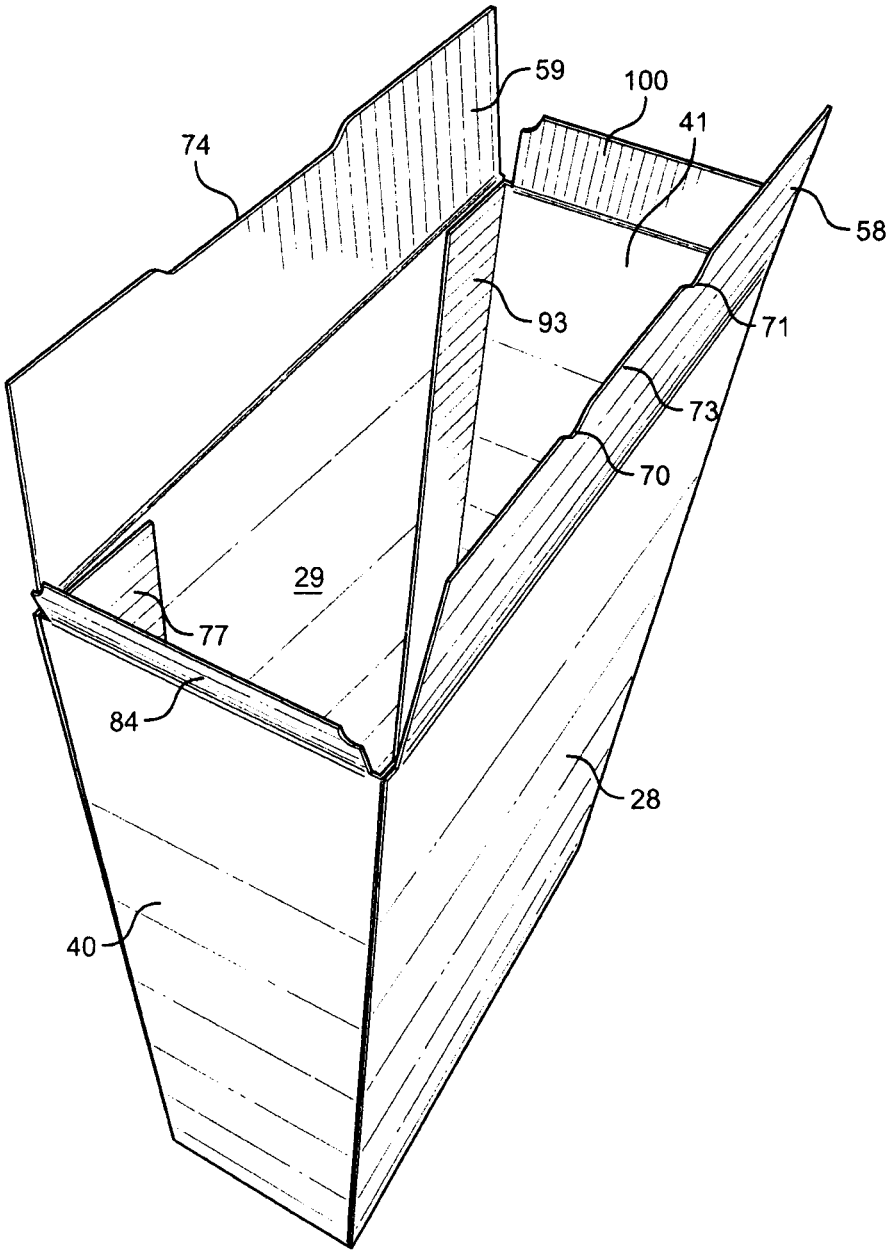
FIG. 1 is a perspective view of an upper portion of an open ended paperboard carton constructed in accordance with the invention.

Initially, it should be noted that the use of terms, such as upper, lower, inner, outer, front, rear, top, bottom and the like, herein is for reference purposes only in describing exemplary forms of the invention as set forth below and illustrated in the drawings. Therefore, these terms should not be considered limiting as to the overall invention.

Figure 2:
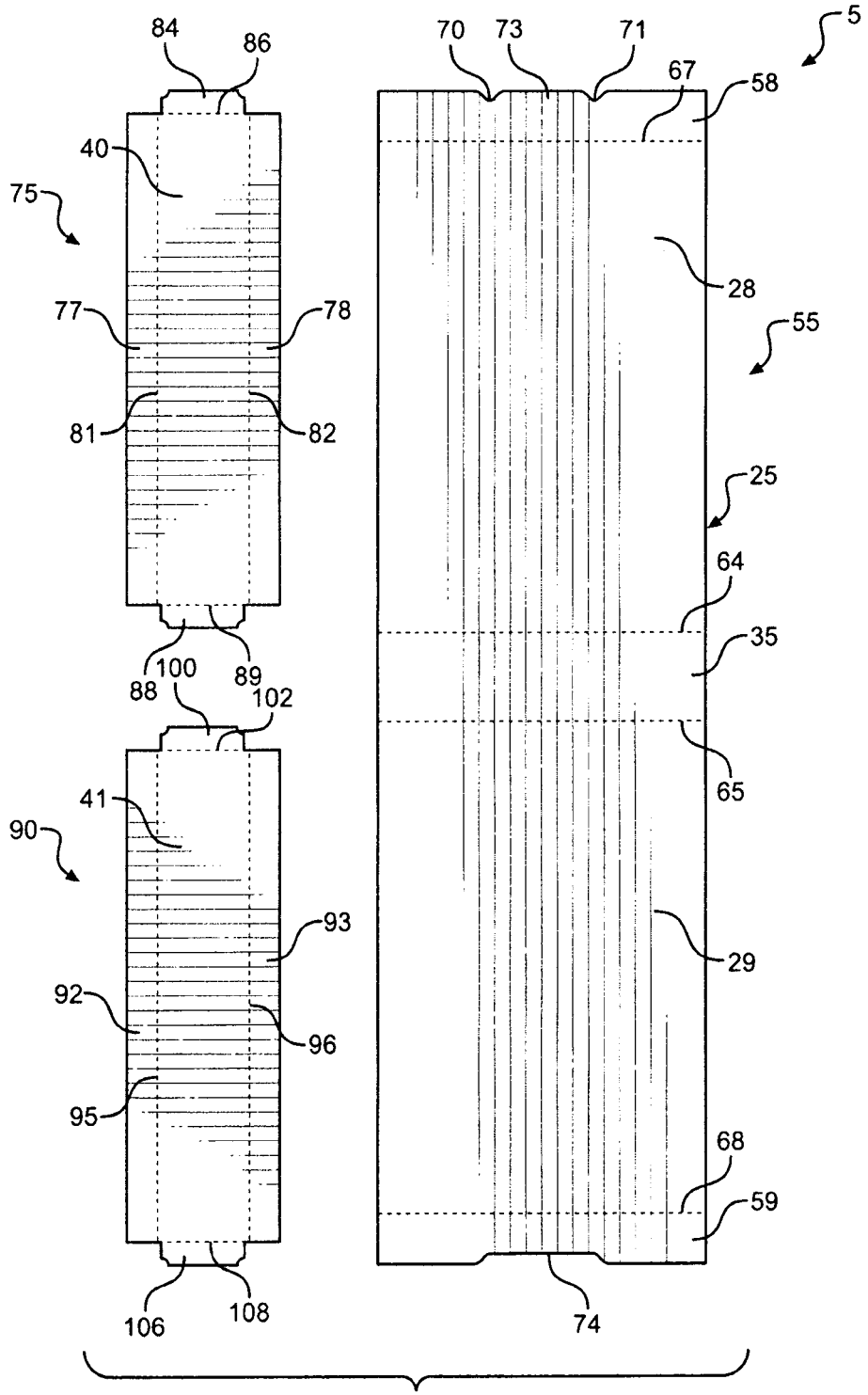
FIG. 2 is a plan view of a paperboard blank assembly from which the carton of FIG. 1 is erected.

With initial reference to FIGS. 1 and 2, an open ended carton constructed in accordance with the present invention is generally indicated at 5. In accordance with a preferred embodiment, carton 5 is formed by interconnecting a main body panel 25, established by first and second side panels 28 and 29 interconnected by a bottom wall 35, and third and fourth side panels 40 and 41. More specifically, with particular reference to FIG. 2, carton 5 is formed by assembling various blanks, with a first blank 55 including first and second side panels 28 and 29, bottom wall 35, an upper flap 58 and a lower flap 59. As indicated, first side panel 28 and second side panel 29 are connected to bottom wall 35 through respective fold lines 64 and 65. In a similar manner, upper flap 58 is joined to first side panel 28 along a fold line 67, while lower flap 59 is joined to second side panel 29 along a fold line 68. Overall, blank 55 is shown to be substantially rectangular in shape, aside from the inclusion of spaced notches 70 and 71 forming a central tab 73 in upper flap 58, and the provision for a central recess 74 in lower flap 59.

Side panel 40 defines part of a second blank 75 of carton 5. In the embodiment illustrated, blank 75 also includes opposing, elongated legs 77 and 78 connected to side panel 40 along fold lines 81 an 82. In addition, side panel 40 includes a top flap 84 having an associated fold line 86, as well as a bottom flap 88 having an associated fold line 89. Symmetrically constructed to second blank 75, carton 5 includes a third blank 90 establishing fourth side panel 41, along with opposing elongated legs 92 and 93 connected to side panel 41 along fold lines 95 and 96, a top flap 100 having an associated fold line 102, and a bottom flap 106 joined to side panel 41 along a fold line 108.

Figure 3:
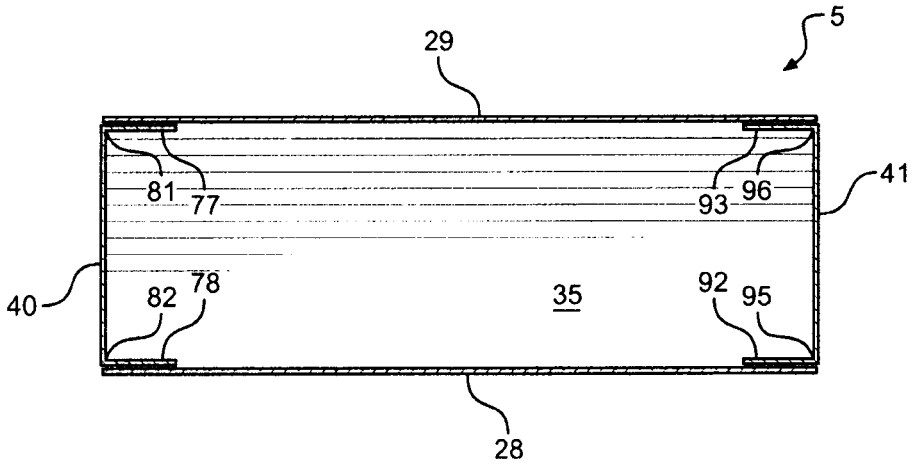
FIG. 3 is top cross-sectional view of the carton of FIG. 1.
Figure 4:
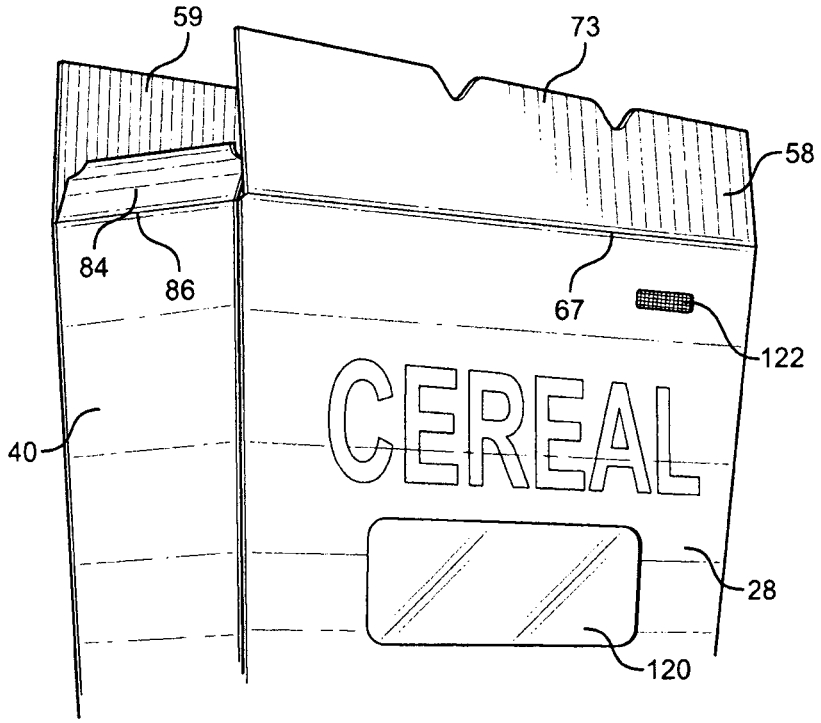
FIG. 4 is a perspective view of an upper portion of a cereal carton according to the construction of FIGS. 1-3.

In assembling or erecting carton 5 to the condition presented in FIGS. 1 and 3, main body piece 5 is folded along lines 64 and 65 such that first and second side panels 28 and 29 are arranged upstanding, substantially parallel to each other and spaced by bottom wall 35. At this point it should be recognized that, at least in the preferred embodiment shown, first and second side panels 28 and 29 are the largest of the side panels of carton 5 in area, i.e., each side panel 28, 29 establishes a face panel for carton 5 having an associated area which is generally in the order of at least three times the surface area of either of third and fourth side panels 40 and 41. For the particular type of carton shown, each of side panels 40, 41 is also greater in area than bottom wall 35. By way of example, side panel 28 can constitute the front face of a cereal carton, such as indicated in FIG. 4, and can be provided with suitable indicia reflecting the name, brand and the like of product contained within carton 5. In addition, one or more of side panels 28, 29, 40 and 41 can include a window and/or vent, such as respectively indicated at 120 and 122 for side panel 28 in FIG. 4. In any case, interconnected along side edge portions (not separately labeled) of each side panel 28, 29 is a respective one of side panels 40 and 41. More specifically, legs 77 and 78 of third side panel 40 are folded inward and secured to, such as through an adhesive, to side edge portions of both first and second side panels 28 and 29, while flap 88 is correspondingly secured to bottom wall 35, such that side panel 40 extends from bottom wall 35 to a height of fold line 67. In a similar manner, legs 92 and 93, as well as flap 106, are folded inward and preferably adhesively secured to opposing side edge portions of both first and second panels 28 and 29 and bottom wall 35, respectively, thereby creating carton 5 with an interior cavity for products to be sold to a consumer, such as edible food products.

With this arrangement, unlike a conventional food carton which is formed by folding a single blank such that there exist a pair of closure flaps to establish both the top and bottom walls of the carton, carton 5 has a solid bottom wall 35. However, in a manner directly corresponding with known cartons of this type, the top of carton 5 can be selectively closed, after being initially opened, by slipping tab 73 of upper flap 58 under lower flap 59 in the region of central recess 74. More importantly, in accordance with the present invention, the formation of carton 5 from the different blanks 55, 75 and 90 advantageous enables side panels 40 and 41 to be constructed different from side panels 28 and 29. More specifically, in accordance with preferred aspects of the invention, a paperboard carton 5 is formed from multiple, separate pieces, with the pieces varying in at least one of basis weight, fiber orientation and material construction to provide carton 5 with increased strength but with a reduction in the amount of fiber utilized, as compared to a conventional carton, as will be detailed fully below.

As indicated above, it is an object of the invention to structure carton 5 to be able to withstand significant vertical loading without being crushed or buckling, thereby enabling multiple cartons 5 to be vertically stacked and have exerted thereon certain vertical loads, even when shipped. Initially, it should be recognized that the vertical load capability of carton 5 is enhanced to a certain degree in accordance with the invention as compared to a conventional carton based on the inclusion of legs 77, 78, 92 and 93, along with the associated connection adhesive, at the vertical corners of carton 5. Therefore, the multi-piece construction of carton 55 contributes to the goals of the invention. However, in accordance with the invention, other structural parameters are also altered to enable the objects of the invention to be achieved. In particular, the basis weight or caliper of the paperboard material of side walls 40 and 41 is made greater than the caliper of side walls 28 and 29. This aspect of the invention can be achieved by reducing the basis weight of side panels 28 and 29, increasing the basis weight of side panels 40 and 41, or both. In accordance with another aspect of the invention, the fiber orientation of side panels 40 and 41 is different than side panels 28 and 29. Most preferably, the paperboard fibers of side panels 28 and 29 are arranged to more predominantly run horizontally, while the fibers of side panels 40 and 41 mainly run vertically. Obviously, paperboard will generally have mixed fiber orientations. However, in accordance with this aspect of the invention, the overall majority of the fiber orientation is controlled. For instance, for side panels 40 and 41, a 5:2 ratio of vertical to horizontal fibers, i.e., predominantly vertical versus predominantly horizontal, can be employed such that at least 70% of the fibers are mainly orientated in the desired direction. In accordance with a still further aspect of the invention, although the entire carton 5 is formed of paperboard, mixed types of materials can be employed, such as non-recycled material for side panels 40 and 41 versus recycled materials for main body piece 25. Overall, the top-to-bottom and side-to-side compression strength can be enhanced by increasing the amount of basis weight of fiber in the areas of the greatest mechanical stresses. In addition, although not shown in the drawings, fluting and/or other shape variations between the side panels 40 and 41 versus side panels 28 and 29 can be employed.

Figure 6:
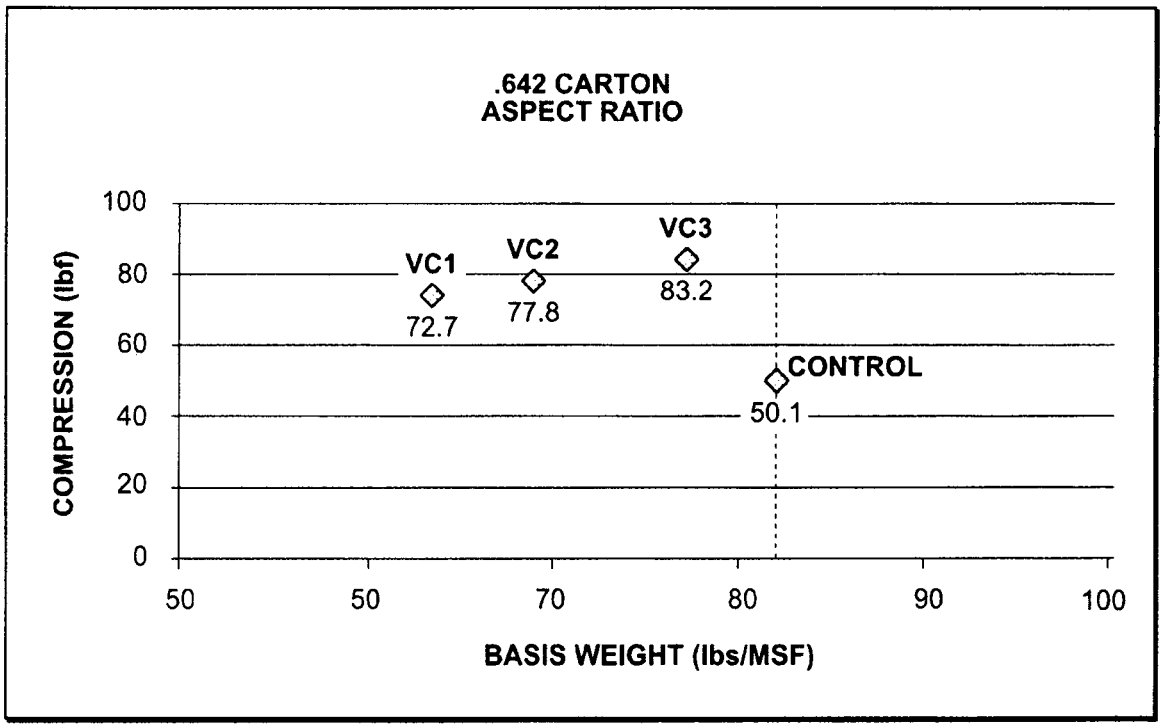
FIGS. 6 and 7 are graphs showing basic weight verses compression strength of cereal boxes constructed in accordance with the invention.
Figure 7:
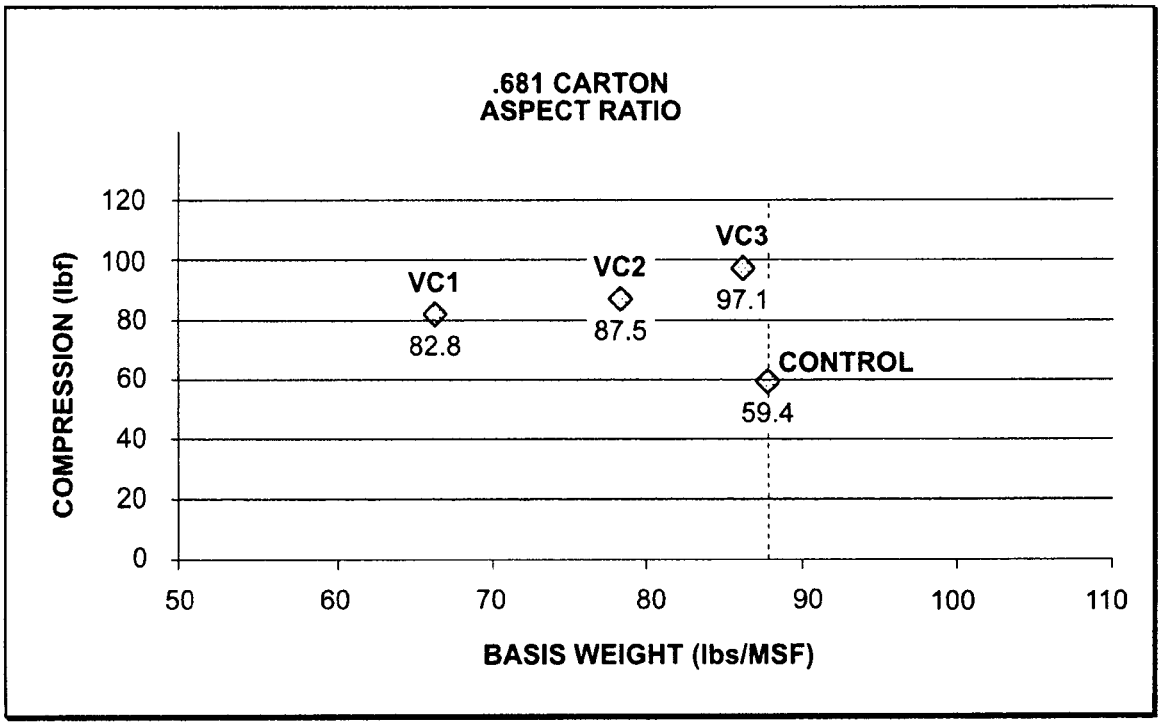

There is seen to exist particular advantages in employing the invention in connection with cartons having aspect ratios of bottom wall to either small side panel, i.e., side panel 40 or 41, which are less than one. That is, although the strength improvement achieved in accordance with the invention can be considered independent of aspect ratio, cartons or boxes including bottoms having associated areas greater than the relative side panels tend to be stronger and therefore may not benefit as much from the invention, at least as compared to cartons which have a relatively small base in combination with fairly large upstanding walls. In any case, by way of examples, graphs are presented in FIGS. 6 and 7 showing basis weight versus compression strength of cereal boxes constructed in accordance with the invention in relation to a standard cereal box for two different potential aspect ratios (specifically surface area aspect ratios of 0.642 and 0.681). Certain key data information is also listed for Tables 1 and 2, including data for the exemplary variable caliper (VC) cartons of the invention.

Table 1

Data Point Key:
Control=current style carton fabrication; 1 piece blank; 20 pt
VC1=VC style carton fabrication; 3 components; 14 pt body+16 pt ends
VC2=VC style carton fabrication; 3 components; 16 pt body+16 pt ends
VC3=VC style carton fabrication; 3 components; 20 pt body+16 pt ends
Aspect Ratio Calculation:
For a 69 $in^3$ volume carton . . .
bottom surface area=9.174 $in^2$
side surface area=14.297 $in^2$
bottom surface area vs. side surface area=9.174/14.297=0.64167

Table 2

Data Point Key:
Control=current style carton fabrication; 1 piece blank; 22 pt
VC1=VC style carton fabrication; 3 components; 14 pt body+20 pt ends
VC2=VC style carton fabrication; 3 components; 18 pt body+20 pt ends
VC3=VC style carton fabrication; 3 components; 22 pt body+20 pt ends
Aspect Ratio Calculation:
For a 172 $in^3$ volume carton . . .
bottom surface area=15.313 $in^2$
side surface area=22.5 $in^2$
bottom surface area vs. side surface area=15.313/22.5=0.68057

Figure 5:
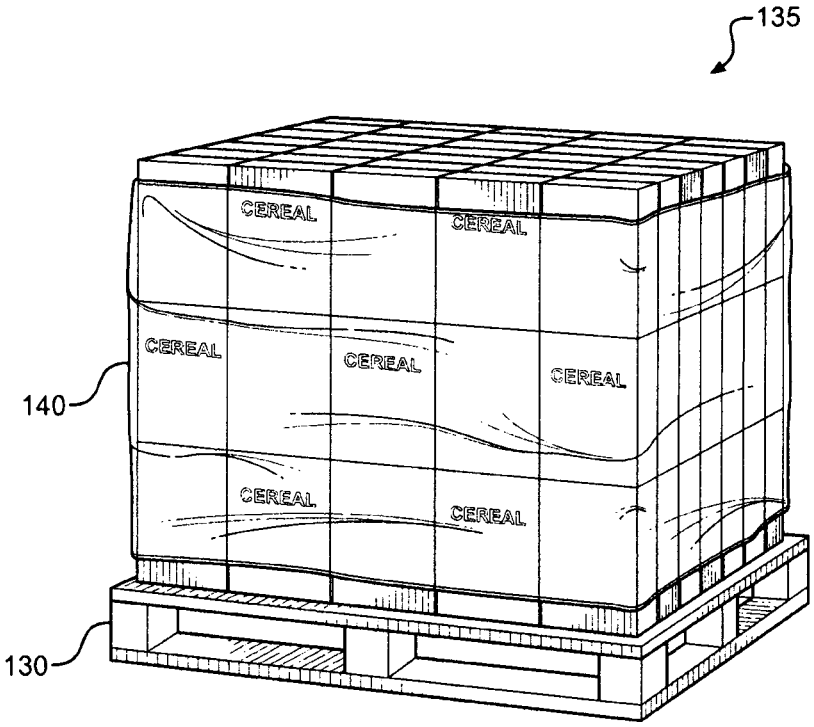
FIG. 5 is a perspective view of an array of the cartons of the invention assembled on a pallet for shipping.

As can be readily seen, the compression strengths associated with the cereal cartons or boxes constructed in accordance with the invention are significantly greater than the compression strength of a conventional cereal carton, even when the basis weight of the cereal cartons made in accordance with the invention is held constant or reduced. Therefore, these tables not only depict how the cartons of the invention can withstand increased vertical loading, but the same can be achieved with fiber reductions and, correspondingly, savings in material costs. For instance, based on information available in Table 2, a carton can be created in accordance with the invention from 14 point paperboard to replace a current style carton made from 22 point paperboard, while still achieving about a 40% increase in strength. This significant change has an abundance of ramifications. For instance, it is possible to avoid the need for additional corrugated shipping boxes. Instead, as represented in FIG. 5, it is possible to load a pallet 130 with an exposed array 135 of stacked cartons constructed in accordance with the invention and employ shrink wrap 140, bands or the like to contain the directly exposed array 135 for shipping purposes. In addition, in practicing the invention it should be noted that known paper mill production techniques do not need to be altered to carry out the invention. That is, the components of the cartons of the invention can be made from standard paperboard stock, while just significantly reducing the fiber content of the paperboard yet still enhancing the compression strength. Instead, the main difference in the carton formation process would be the addition of the assembly of the carton from the individual pieces. However, this process can be readily automated, such as at a food packaging plant, without affecting the paper mill operation.

Based on the above, it should be readily apparent that the invention provides for an end load carton with enhanced compression strength even with a reduction in basis weight.

Although disclosed with reference to preferred embodiments of the invention, is should be readily apparent that various changes and modifications can be made to the invention without departing from the spirit thereof. For instance, the legs employed in attaching the main body piece and each side panel could instead be provided on the main or face panels. In addition, the legs could be arranged on either the inside or outside of the carton. Furthermore, assembly can be achieved utilizing means other than adhesive, such as ultrasonic welding. Finally, the cartons can be employed to house various products, including additional food products like noodles. In any case, the invention is only intended to be limited by the scope of the following claims.

The invention claimed is:

1. A carton comprising:

a main body piece which is folded to establish a bottom wall and first and second side panels which are spaced by the bottom wall, each of the first and second side panels including first and second opposing side edge portions;

a third side panel extending between and secured to the bottom wall and the first side edge portions of the first and second side panels; and a fourth side panel extending between and secured to the bottom wall and the second side edge portions of the first and second side panels, wherein:

a) said main body piece, the third side panel and the fourth side panel constitute separate pieces which are interconnected to form the carton with an interior cavity adapted to contain at least one edible product to be sold to a consumer, b) each of said main body piece, the third side panel and the fourth side panel is formed of paperboard, c) a caliper of each of the third and fourth side panels is greater than the main body piece, d) the carton exhibits a compression strength which enables similarly configured cartons to be directly stacked upon each other for shipping purposes while resting on their respective bottom walls, and e) the bottom wall is smaller in area than any one of the first, second, third or fourth side panels, and each of the first and second side panels is larger in area than any one of the bottom wall, third side panel or fourth side panel.

2. The carton of claim 1, wherein a predominate fiber orientation in each of the third and fourth side panels directionally differs from each of the first and second side panels.

3. The carton of claim 2, wherein the predominate fiber orientation in each of the third and fourth side panels is vertical and the predominate fiber orientation in each of the first and second side panels is horizontal.

4. The carton of claim 1, wherein the carton constitutes a cereal carton.

5. The carton of claim 1, wherein the carton forms one of a plurality of similarly constructed cartons which are stacked in an exposed array on a pallet for shipping purposes.

6. The carton of claim 5, wherein said plurality of cartons are wrapped together for shipping purposes.

7. The carton of claim 1, further comprising at least one of a window and a vent provided in at least one of the first, second, third or fourth wall panels.

8. The carton of claim 1, wherein a material composition of each of said third and fourth side panels is different than the main body piece.

9. A carton comprising:

a main body piece which is folded to establish a bottom wall and two spaced, upstanding face panels, with each of the face panels including first and second opposing side edge portions;

a first side wall extending between and secured to the bottom wall and the first side edge portions of the face panels; and a second side wall extending between and secured to the bottom wall and the second side edge portions of the face panels, wherein:

a) said main body piece, the first side wall and the second side wall constitute separate pieces which are interconnected to form the carton with an interior cavity adapted to contain items to be sold to a consumer, b) each of said main body piece, the first side wall and the second side wall is formed of paperboard, while a material composition of each of the first and second side walls is different than the main body piece, c) each of the face panels has an associated area which is greater than either of the first or second side walls, d) a predominate fiber orientation of each of the first and second side walls directionally differs from each of the face panels, e) the carton exhibits a compression strength which enables similarly configured cartons to be directly stacked upon each other for shipping purposes while resting on their respective bottom walls, and f) the bottom wall is smaller in area than any one of the two spaced, upstanding face panels, first side wall or second side wall, and each of the first and second side walls is larger in area than any one of the bottom wall or two spaced, upstanding face panels.

10. The carton of claim 9, wherein a predominate fiber orientation in each of the first and second side walls is vertical and a predominate fiber orientation in each of the face panels is horizontal.

11. The carton of claim 9, wherein a caliper of the material composition of the face panels is less than a caliper of the material composition of the first and second side walls.

12. The carton of claim 9, wherein the carton constitutes a cereal carton.

13. The carton of claim 12, wherein the carton forms one of a plurality of cartons which are stacked in an exposed array on a pallet for shipping purposes.

14. The carton of claim 13, wherein said plurality of cartons are wrapped together for shipping purposes.

15. The carton of claim 9, further comprising at least one of a window or vent provided in at least one of the face panels and the first and second side walls.

16. A method of forming a carton comprising:

folding a main body piece which is formed of paperboard to establish a bottom wall and two spaced, upstanding face panels, with each of the face panels including first and second opposing side edge portions;

attaching a first side wall, which is made from paperboard having a caliper greater than a caliper of either of the face panels, a fiber orientation which directionally differs from either of the face panels and a surface area which is less than a surface area of either of the face panels, to the bottom wall and the first side edge portions of the face panels; and attaching a second side wall, which is made from paperboard having a caliper which is greater than the caliper of either of the face panels, a fiber orientation which directionally differs from either of the face panels and a surface area which is less than the surface area of either of the face panels, to the bottom wall and the second side edge portions of the face panels to form the carton having an interior cavity adapted to contain items to be sold to a consumer and an associated compression strength which enables similarly configured cartons to be directly stacked upon each other for shipping purposes while resting on their respective bottom walls and wherein the bottom wall is smaller in area than any one of the two spaced, upstanding face panels, first side wall or second side wall, and each of the first and second side walls is larger in area than any one of the bottom wall or two spaced, upstanding face panels.

17. The method of claim 16, further comprising: stacking a plurality of the cartons in an exposed array on a pallet for shipping purposes.

18. The method of claim 17, further comprising: wrapping the plurality of cartons together for shipping purposes.

* * * * *